US005335813A

United States Patent [19]

Qi

[11] Patent Number: 5,335,813

[45] Date of Patent: Aug. 9, 1994

[54] DOUBLE-VESSEL CAN

[76] Inventor: Hao Qi, 33 Forestbrook Cr., Scarborough, Ontario, Canada, M1T 1S7

[21] Appl. No.: 95,847

[22] Filed: Jul. 22, 1993

Related U.S. Application Data

[63] Continuation-in-part of Ser. No. 984,316, Dec. 2, 1992, abandoned.

[51] Int. Cl.[5] ..... B65D 21/02

[52] U.S. Cl. ..... 220/524; 220/23.83; 220/506; 220/906

[58] Field of Search ..... 206/514; 220/521, 906, 220/23.4, 23.83, 23.86, 524, 500, 619, 620, 506; 215/6, 10

[56] References Cited

U.S. PATENT DOCUMENTS

| | | | |
|---|---|---|---|
| 359,826 | 3/1987 | Walsh . | |
| 1,310,516 | 7/1919 | Xardell . | |
| 3,045,859 | 7/1962 | McMahon . | |
| 3,081,926 | 3/1963 | Newton . | |
| 3,355,053 | 11/1967 | Sexton . | |
| 3,459,295 | 8/1969 | Cousar | 215/6 |
| 3,698,596 | 10/1972 | Potts . | |
| 3,705,661 | 12/1972 | Davis | 215/6 |
| 3,986,632 | 10/1976 | Morrison et al. | 220/906 |
| 4,548,339 | 10/1985 | Gorman | 215/6 |
| 4,919,295 | 4/1990 | Hitzler . | |
| 5,056,681 | 10/1991 | Howes . | |
| 5,197,602 | 3/1993 | Biesecker et al. | 206/514 |

FOREIGN PATENT DOCUMENTS

| | | |
|---|---|---|
| 4-44955 | 2/1992 | Japan . |
| 4-72143 | 3/1992 | Japan . |

*Primary Examiner*—Stephen Castellano
*Attorney, Agent, or Firm*—Riches, McKenzie & Herbert

[57] ABSTRACT

This invention relates to a multiple cell container comprising: a hollow outer vessel having a top edge about a perimeter of an open top; a hollow internal vessel having a top rim about a perimeter of an open top, the internal vessel being housed within the outer vessel with a first portion of the rim being in overlapping juxtaposition with an adjacent portion of the top edge, a second portion of the rim spanning across said open top of the outer vessel; a cap closing said open tops of both the outer and internal vessels thus defining a first closed cell within the internal vessel and a second closed cell within the outer vessel external to the internal vessel, the cap having an inverted peripheral channel about an outer edge of the cap, and an inverted interior channel spanning between and communicating with said peripheral channel, the peripheral channel of the cap being sealingly secured to the top edge of the outer vessel and the overlapping portion of the rim, and the interior channel being sealingly secured to the second portion of the rim, the interior channel and second rim portion defining a seam folded over a top face of the cap. A method of manufacturing a filled multiple cell container is also provided.

5 Claims, 6 Drawing Sheets

DOUBLE-VESSEL CAN

REFERENCE TO RELATED APPLICATION

This application is a continuation-in-part U.S. application Ser. No. 07/984,316 filed Dec. 12, 1992, now abandoned.

FIELD OF THE INVENTION

The invention relates to containers having two vessels or enclosed cells for liquids, or flowable solids, for use as soft drink or beer cans, for example.

BACKGROUND OF THE INVENTION

The conventional soft drink or beer can comprises a substantially cylindrical sheet metal vessel with a disk shaped sheet metal cap sealingly secured to an upper edge of the vessel. Such conventional vessels are formed of recyclable aluminium or steel in a sheet metal process which is well known to those skilled in the art.

The conventional soft drink or beer can contains a single liquid, however it has in the past been proposed to modify such a can by including an internal vessel to hold a second liquid.

An example of such a multi-celled drink container is described in U.S. Pat. No. 4,919,295 to Hitzler. Hitzler uses an obsolete cylindrical outer vessel shape. The currently used cans are formed with a tapered neck in a smooth-necking process from an open topped cylindrical blank. The modern necking process technology results in material savings, enhances resistance to vertical stacking forces, and reduces storage space.

The internal vessel of Hitzler comprises a semi-circular prismatic vessel which abuts one half of the internal wall of the outer cylindrical vessel. The cap of the can of Hitzler is comprised of two semi-circular disk portions which are joined together at their straight sides. The straight sides are joined at their bottom side to the upstanding straight edge of the internal vessel to form a central seam across the top surface of the finished circular cap.

The multi-celled container described by Hitzler suffers from the disadvantage that the two-piece cap member is relatively complicated and difficult to fabricate in practice. The cap is comprised of two portions which must be joined together with the internal vessel at the center line of the cap. In most cases the liquid contained within such vessels is under pressure and the reliability of the seal made between the vessels and the external atmosphere is extremely critical. This is especially true when food products are stored within the cells of the container.

A further disadvantage to the multi-celled container of Hitzler is that the volume of liquid stored in the internal vessel is less than the volume which can be contained in the remaining portion of the outer vessel. Since the cap is sealed along its center line, the volume of liquid within the semi-circular internal vessel is less than one half of the internal volume of the outer vessel due to the wall thickness of the internal vessel.

The inability to contain equal volumes is disadvantageous in that the marketability of the multiple cell container is limited thereby. For example, three multiple celled containers could be used to replace a standard six pack of equal volume. If the liquids in the containers were to be mixed in equal volumes for certain applications such as for example epoxy resin and epoxy setting compounds, the application of unequal volumes would inhibit such use.

A multiple celled container could also be used as a promotional item to sell equal volumes of two of a companies products. For example a beer company may wish to sell a lager and an ale together in a multiple celled container as a promotional sales tool. The inability to sell equal volumes of liquid product in both sides of the multiple celled container adds to production considerations and labelling requirements. As a result, the attractiveness of the multiple celled container as a promotional device is diminished.

Therefore it is desirable to produce a multiple celled container which is easily and simply fabricated with a minimum number of parts but also results in a secure seal between the multiple cells and the outside atmosphere.

It is also desirable to produce a multiple celled container wherein the volumes contained within each separate cell are equal.

To ensure marketplace acceptance of any double vessel container, it is a practical necessity that the latest current shape of outer vessel be used. The outer vessels are formed and printed in massive volumes with existing machinery, and any proposed modification that requires a change to accepted manufacturing procedures would likely be a commercial failure. Therefore it is desirable to produce a multiple celled container wherein the volumes contained within each separate cell are equal and wherein the outer vessel is of the latest commonly used standard shape.

SUMMARY OF THE INVENTION

The invention addresses the disadvantages of the prior art in a novel manner in the provision of a multiple cell container comprising: a hollow outer vessel having a top edge about a perimeter of an open top; a hollow internal vessel having a top rim about a perimeter of an open top, the internal vessel being housed within the outer vessel with a first portion of the rim being in overlapping juxtaposition with an adjacent portion of the top edge, a second portion of the rim spanning across said open top of the outer vessel; a cap closing said open tops of both the outer and internal vessels thus defining a first closed cell within the internal vessel and a second closed cell within the outer vessel external to the internal vessel, the cap having an inverted peripheral channel about an outer edge of the cap, and an inverted interior channel spanning between and communicating with said peripheral channel, the peripheral channel of the cap being sealingly secured to the top edge of the outer vessel and the overlapping portion of the rim, and the interior channel being sealingly secured to the second portion of the rim, the interior channel and second rim portion defining a seam folded over a top face of the cap.

The invention also provides a method of manufacturing a filled multiple cell container comprising:

substantially filling a hollow internal vessel, having a top rim about a perimeter of an open top, with a first liquid to a level below said top rim, the rim comprising a first and second rim portion;

closing the open top of said internal vessel with a cap, the cap thus defining a first closed cell within the internal vessel, the cap having an inverted peripheral channel about an outer edge of the cap and an inverted interior channel spanning between and communicating with said peripheral channel, the interior channel of the cap being engaged upon the second rim portion, and at least a part of the peripheral channel being engaged upon the first rim portion;

sealingly securing the interior channel to the second portion of the rim;

folding the interior channel and second rim portion over a top face of the cap thus defining a folded seam, merging with said peripheral channel at extreme ends of the seam;

partially filling a hollow outer vessel with a second liquid, the outer vessel having a top edge about a perimeter of an open top;

inserting the internal vessel within the outer vessel, at least a bottom portion of the internal vessel being immersed in said second liquid, the first portion of the rim being in overlapping juxtaposition with an adjacent portion of the top edge, the second portion of the rim spanning across said open top of the outer vessel;

closing the open top of the outer vessel with said cap, thus defining a second closed cell, containing said second liquid, within the outer vessel external to the internal vessel;

sealingly securing the peripheral channel of the cap to the top edge of the outer vessel and the overlapping first portion of the rim.

Preferably the step of sealingly securing the peripheral channel comprises:

reverse folding the peripheral channel to envelop said top edge and said overlapping first rim portion;

double reverse folding the peripheral channel with top edge and overlapping first rim portion enveloped therein to form a peripheral bead;

whereby the first overlapping portion of the rim is sealingly secured and folded with said top edge within said peripheral bead.

The folded seam is preferably located at the center line of a circular cap for visual effect indicating equal volumes of the liquids stored in each of two cells of the container. The seam is folded over through 90° flat onto the top of the cap to produce an improved seal and to secure the rim of the internal vessel within the interior channel of the cap. The folded seam is capable of sealing higher pressures, and resisting leakage after impact, as well as being suitable for use with thin gauge material.

The internal vessel is advantageously constructed of a cylindrical can, of diameter less than that of the outer vessel, and then flattened at its top end to form a semi-circular rim. An internal vessel, forming a first closed cell, can be so constructed to have a volume which is equal to the volume of a second closed cell, defined within the outer vessel external to the inner vessel. By defining two cells of equal volume, the practical commercial application of the container is enhanced. For example, two separate containers can be replaced by a larger multi-celled container reducing labelling costs and storage space. Comparison between two products may be promoted, or samples of two products of equal volume may be sold together in a multi-cell container.

Further aspects of the invention will become apparent upon review of the following detailed description.

BRIEF DESCRIPTION OF THE DRAWINGS

In order that the invention may be readily understood, a preferred embodiment of the invention will be described by way of example with reference to the accompanying drawings in which:

FIGS. 10–13 show the detailed configuration of the internal vessel wherein:

FIG. 10 is an elevation view of the internal vessel;

FIG. 11 is a top plan view of the internal vessel;

FIG. 12 is a bottom plan view of the internal vessel;

FIG. 13 is a sectional elevation view along line 13—13 of FIG. 10.

DETAILED DESCRIPTION OF PREFERRED EMBODIMENTS OF THE INVENTION

Figure 1:
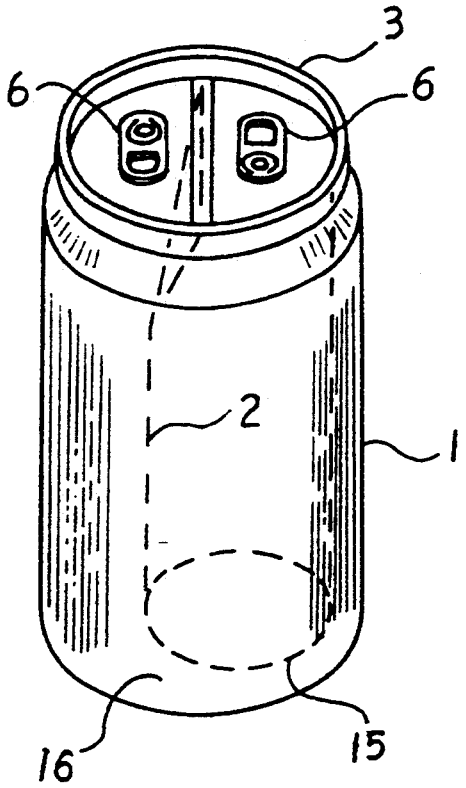
FIG. 1 is an upper perspective view of a soft drink can having an internal vessel shown in hidden dashed outline.
Figure 2:
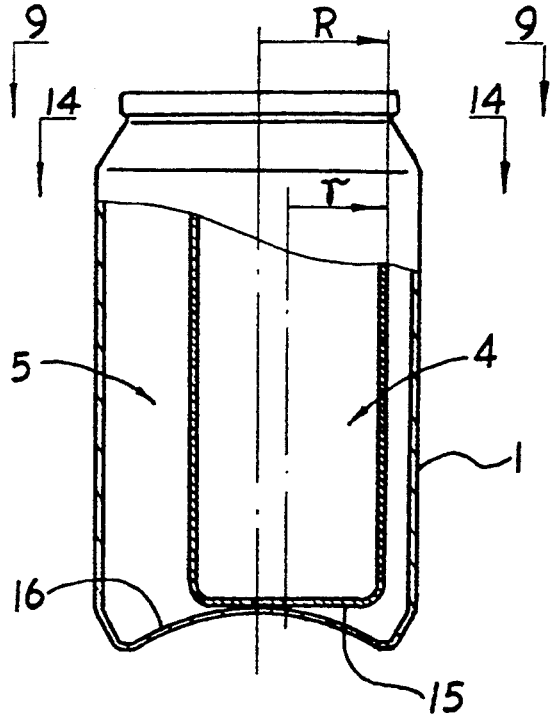
FIG. 2 is a vertical partially broken away sectional view through the can of FIG. 1.

FIG. 1 shows the general arrangement of a multiple celled container according to the invention having a hollow outer vessel 1 and a hollow internal vessel 2. A disk shaped cap 3 seals the tops of both the outer vessel 1 and internal vessel 2 thus defining a first and second closed cells 4 and 5. As shown in FIG. 2, the first closed cell is defined within the internal vessel 2 and the second closed cell 5 is defined within the outer vessel 1 external to the internal vessel 2.

As shown in FIG. 1, the cap 3 is preferably a circular disk with a seam 10 dividing it symmetrically into two semi-circular portions. Each semi-circular portion includes separate openable means 6, which may take the form of any conventional beverage container opening.

Figure 8:
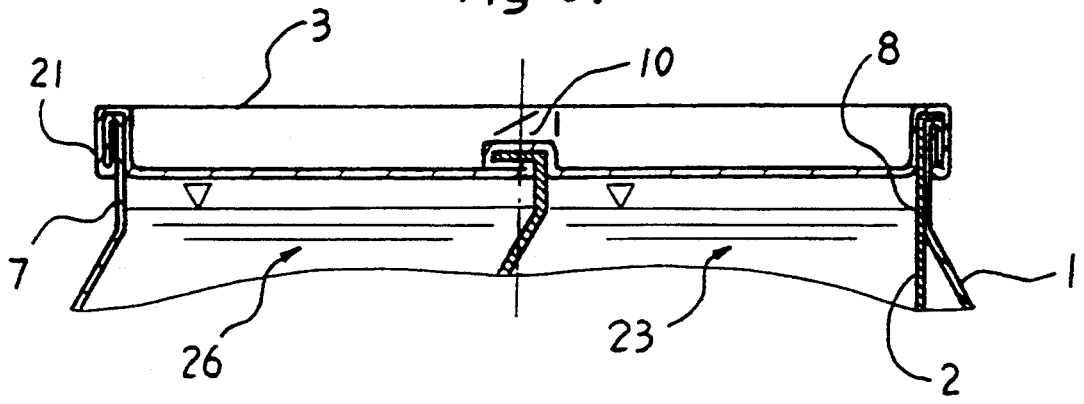
Figure 9:
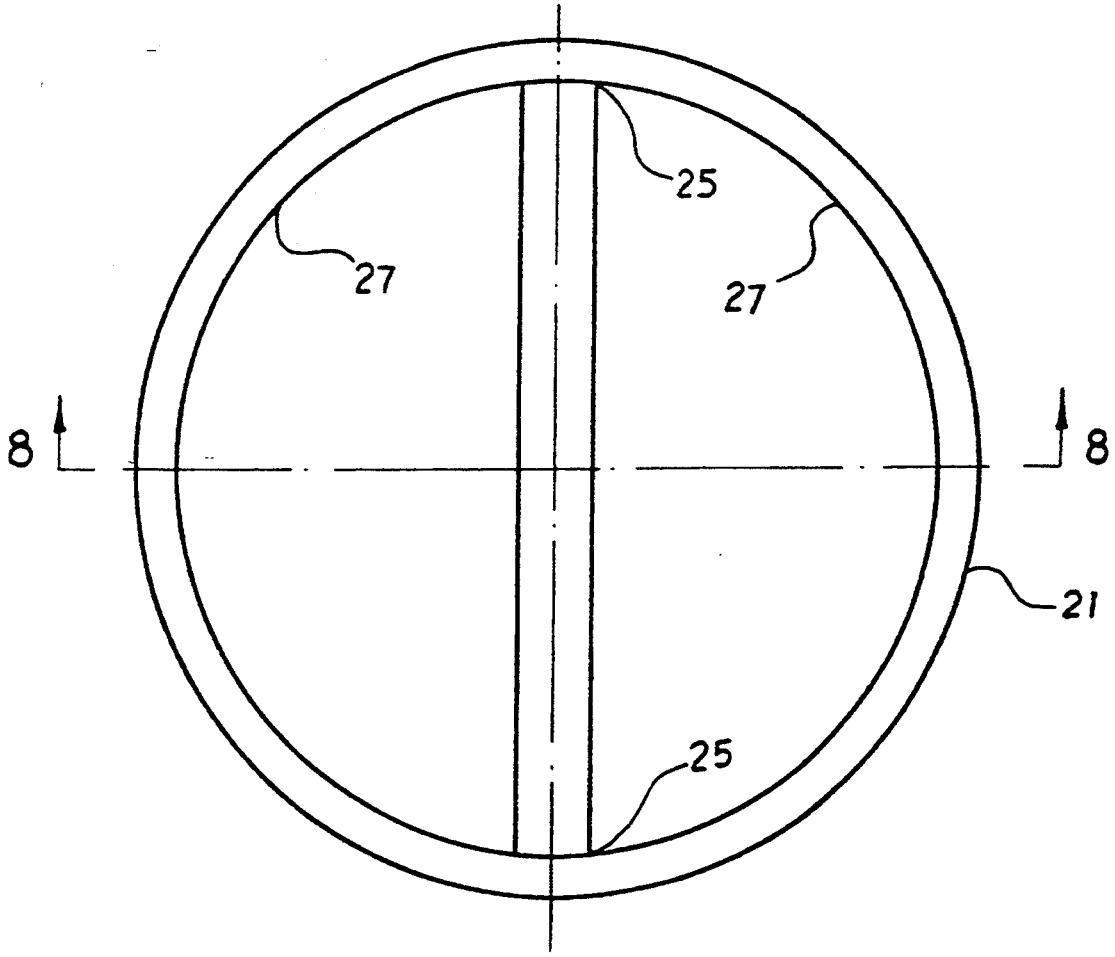
FIG. 9 is a plan view of the top cap of the can, showing the details of the folded middle seam at its completed stage.
Figure 11:
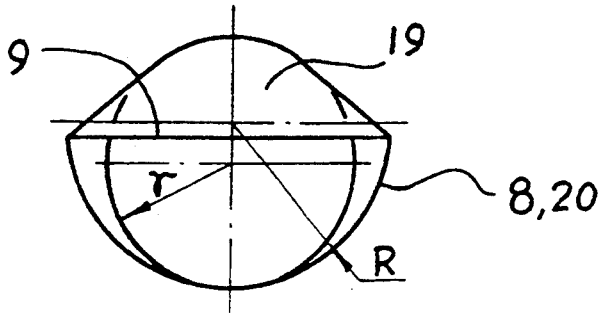
Figure 10:
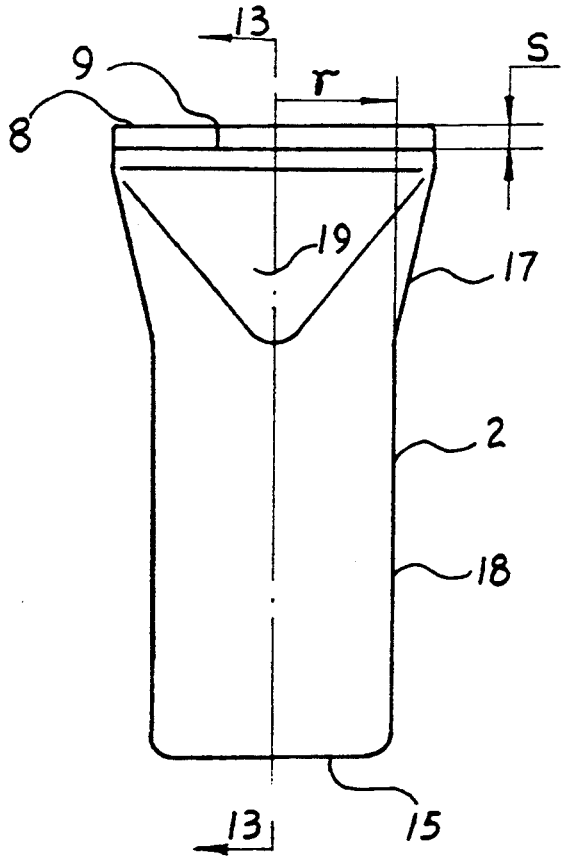
Figure 12:
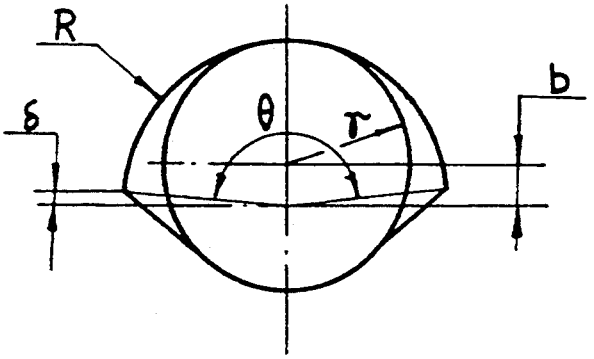

The novel features of the cap 3 and means by which the first and second cells 4 and 5 are sealed is shown in the sectional view of FIG. 8 and top plan view of figure 9. The outer vessel 1 is hollow and has a top edge 7 about a perimeter of an initially open top.

The hollow internal vessel 2 has a top rim 8 about the perimeter of its initially open top. In the preferred embodiment illustrated, the top rim 8 is comprised of a semi-circular first portion 20 and a straight portion 9. The internal vessel 2 is housed within the outer vessel 1 with the first overlapping portion 20 of the rim 8 being in overlapping juxtaposition with the adjacent portion of the top edge 7. The second straight portion 9 of the rim 8 spans across the initially open top of the outer vessel 1. The second straight portion 9 is received in an adjacent inverted interior channel 13 of the cap 3 to form a seam 10. The seam 10 in the embodiment shown is singly folded flat upon the top face 11 of the cap 3.

The final configuration of the cap 3 is shown in FIGS. 8 and 9, whereas FIGS. 3 to 7 show the progressive formation of the edge bead 21 and central seam 10.

Figure 3:
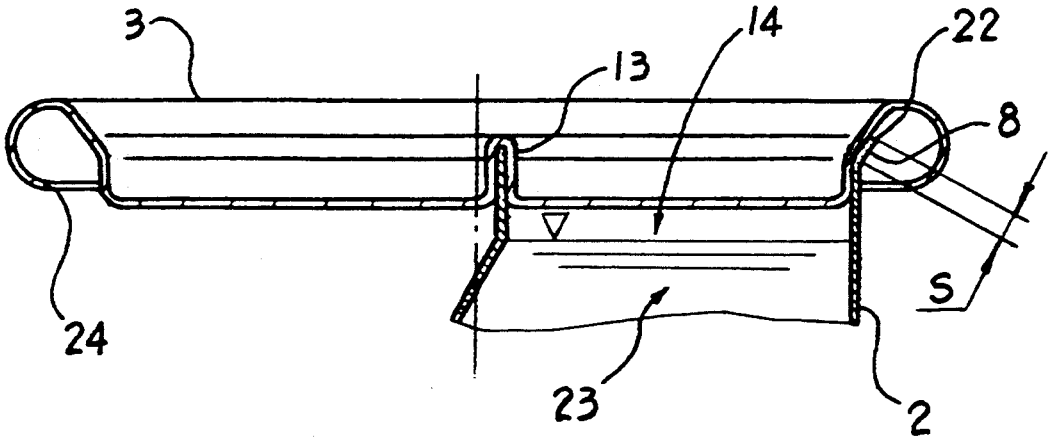
FIGS. 3, 4, 6, 7 and 8 are sectional detail views showing the progressive formation of the middle seam and edge bead to seal the top ends of the inner and outer vessels.

As shown in FIG. 8 the outer vessel 1 has a top edge 7 about the perimeter of an initially open top. Hollow internal vessel 2 has a top rim 8 about the perimeter of its initially open top. The cap 3, as seen in FIG. 3, has an inverted peripheral channel 12 about an outer edge of the disk shaped cap 3. The cap 3 also has an inverted interior channel 13 spanning between and communicating with the peripheral channel 12.

It will be apparent that the filling of the cells of the container and method of manufacturing the container are inextricably linked together. The method used to manufacture a multiple celled container is described below in accordance with the invention.

Figure 13:
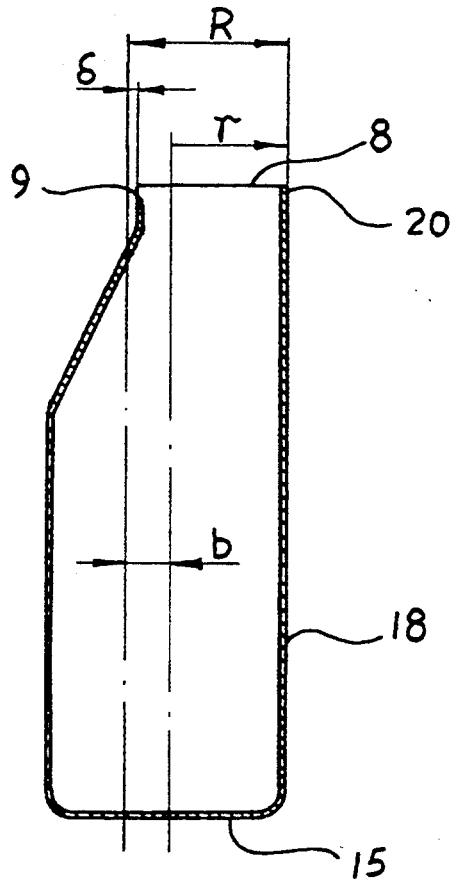

As shown in FIG. 3, the hollow internal vessel 2 has a top rim 8 about the perimeter of its open top. The rim 8 has a first substantially semi-circular portion 20 and a second substantially straight portion 9. As best shown in FIG. 13, the second portion 9 is stepped downwardly from the first portion 20 a dimension S. As shown in figure the upper extremity of the rim 8 is initially formed into a outwardly turned lip 22, which has a width of approximately dimension "S". The lip 22 serves to guide the cap 3 during placement of the cap 3, and is folded into the outer bead 21 when the can is completely fabricated.

The hollow internal vessel 2 is substantially filled with a first liquid 23 to a level below the top rim 8.

The open top of the internal vessel 2 is then closed with the cap 3 as illustrated in FIG. 3. The cap 3 thus defines a first closed cell 4 within the internal vessel 2. The cap 3 has an inverted peripheral channel 12 about an outer edge 24 of the cap 3. The cap 3 also has an inverted interior channel 13 which is engaged upon the second rim portion 9 of the internal vessel 2. In the embodiment illustrated substantially one half of the peripheral channel 12 is engaged upon the first rim portion 20. Sealant material may be coated on mating surfaces of the cap 3 to improve leak resistance.

As is conventional, the first liquid 23 contains chemicals which over time creates carbon dioxide to carbonate the liquid. The chemical reaction occurs slowly over time, and therefore when the internal vessel 2 is first filled, the first liquid 23 does not exert appreciable pressure on the cap 3. After the completion of the manufacturing of the sealed multiple celled container, the carbonation process continues until the liquids 23, 26 within the cells 4, 5 are fully pressurized.

When the cap 3 has been inserted upon the filled hollow internal vessel 2, the interior channel is sealingly secured to the second portion 9 of the rim 8, by pinch rollers for example.

Figure 4:
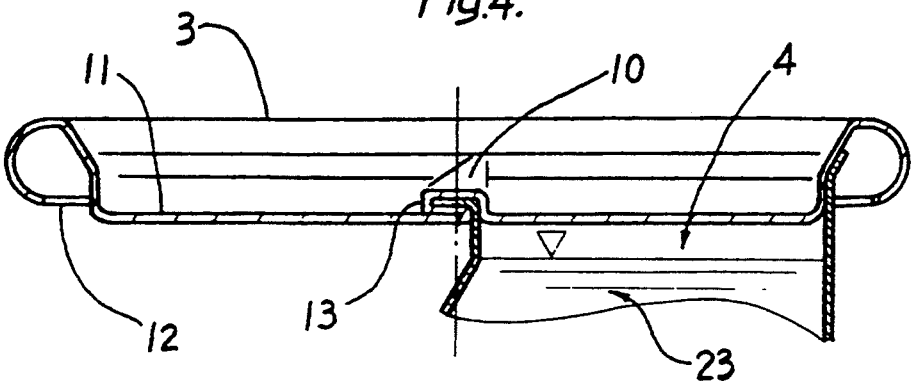
Figure 5:
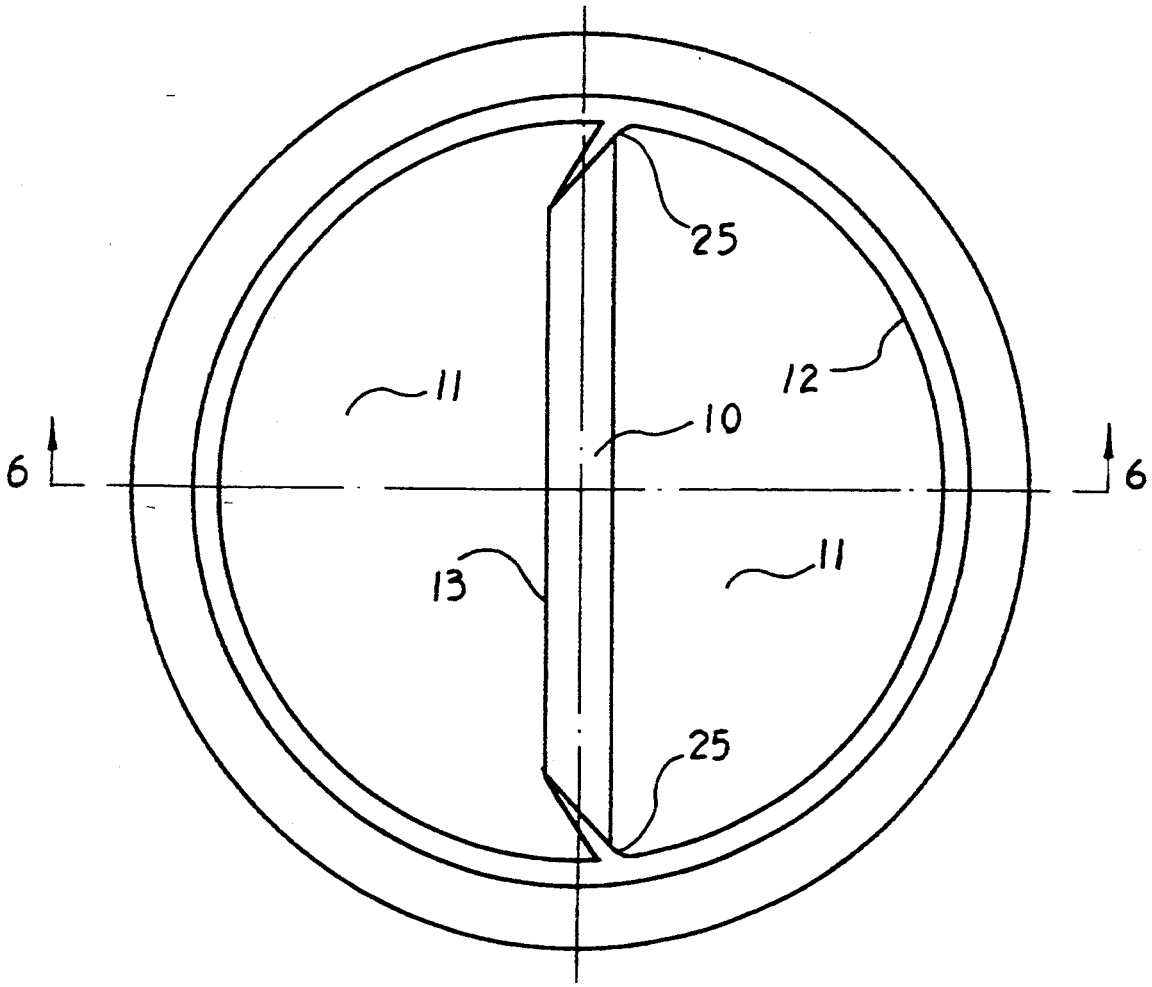
FIG. 5 is a plan view of the top cap of the can, showing the details of the folded middle seam in an intermediate stage.

The next step as indicated in FIGS. 4 and 5 is to fold the interior channel 13 and second rim portion 9 over a top face 11 of the cap 3. As a result, a folded seam 10 is defined merging with the peripheral channel 12 at extreme end 25 of the seam 10. In the embodiment illustrated the seam 10 is singly folded flat upon the top face 11 of the cap 3. It will be apparent that the seam 10 could be double folded if desired. The seam 10 symmetrically divides the top face 11 of the cap 3 primarily for visual effect. The cap 3 is substantially a circular disk with the seam 10 dividing the cap 3 into two semi-circular portions. As shown in FIGS. 4 and 5, the central plane of the cap 3 and outer vessel 1 is indicated at line x—x for pleasing visual effect therefore the seam 10 in its final folded position is centered about line x—x.

Figure 6:
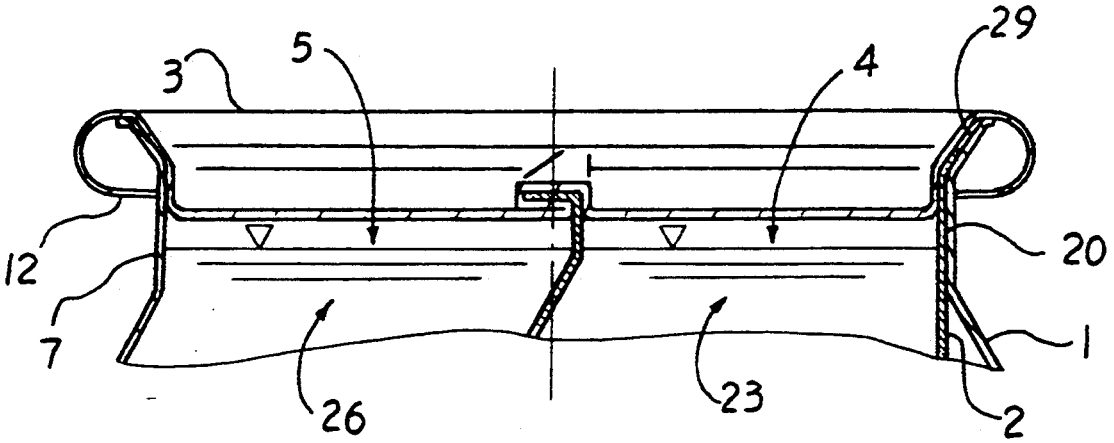

The next step in the manufacturing procedure is to partially fill the hollow outer vessel 2 with a second liquid 26. The outer vessel 1 has a top edge 7 about the perimeter of its open top. As shown in FIG. 6, the top edge 7 has a upwardly outwardly tapered lip 27 which serves to guide the cap 3.

The internal vessel 2 is then inserted within the outer vessel 1. The bottom portion of the internal vessel 2 is immersed in the second liquid 26 and when the internal vessel 2 is finally positioned preferrably the levels of the first liquid 23 and second liquid 26 are approximately equal as shown in FIG. 6. The first portion of the rim 20 is in overlapping juxtaposition with an adjacent of the top edge 7, as drawn to the right of FIG. 6. As shown in the mid-portion of the FIG. 6, the second portion 9 of the rim 8 spans across the open top of the outer vessel 1.

As shown in FIG. 6 therefore the cap 3 closes the open tops of both outer vessel 1 and internal vessel 2 thus defining a first closed cell 4 within the internal vessel 2 and a second closed cell 5 within the outer vessel 1 external to the internal vessel 2. The inverted peripheral channel 12 of the cap 3 is positioned about the outer edge 24 of the cap 3 to engage the full extent of the top edge 7 of the outer vessel 1, and also to engage the semi-circular overlapping portion 20 of the top rim 8 of the internal vessel 2. The inverted interior channel 13 of the cap 3 spans between and communicates with the peripheral channel 12 in order that the cap 3 may be placed over both the open tops of the internal vessel 2 and outer vessel 1.

As a result of positioning the cap 3, as shown in FIG. 6, the open top of the outer vessel 1 is closed with the cap 3. Therefore the cap 3 defines a second closed cell 5 containing the second liquid 26 within the outer vessel 1 external to the internal vessel 2. Carbonation of the second liquid 26 occurs in substantially the same manner over time as described above in relation to the first liquid 23.

The next step in the manufacturing procedure is to sealingly secure the peripheral channel of the cap 3 to the top edge 7 of the outer vessel and the overlapping first portion of the rim 8. The sealing procedure is shown in stepwise progression from FIG. 6 to FIG. 7 to the final position illustrated in FIG. 8.

Figure 7:
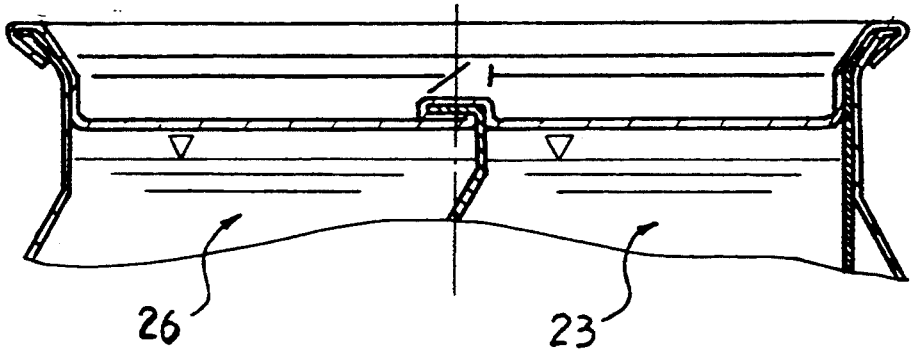

As can be seen in comparison between FIGS. 6 and 7 the step of sealingly securing the peripheral channel 12 preferrably involves the double reverse folding of the peripheral channel 12. Firstly the peripheral channel is reverse folded as shown in FIG. 7 to envelop the top edge 7 and the overlapping first rim portion 20. As is conventional, chemical sealants or liquid rubber are used to coat the sealing surfaces of the peripheral channel 12.

In the progression shown from FIG. 7 to figure 8, the peripheral channel is double reverse folded with the top edge 7 and overlapping first rim portion 20 enveloped within the peripheral channel 12 to form a peripheral bead 21.

As indicated by a comparison between the intermediate stage of the cap 3 in FIG. 5 and the final cap 3 shown in FIG. 9, a further step is undertaken which involves flattening of the extreme ends 25 of the seam 10 to form a substantially right-angled corner merging together the seam 10 and interior surface 27 of the peripheral bead 21. The flattening process can be carried out by pinching dies which clamp the outer surface of the peripheral bead 21.

The folding over of the top rim 8 sandwiched within the peripheral channel 12 and interior channel 13 provides an improved secure seal for the liquid contained in the first closed cell 4.

A novel feature of the invention is that the first cell 4 and the second cell 5 have substantially equal volumes thus increasing the likelihood of commercial exploitation of the multicell container.

FIGS. 10–13 show the detailed construction of the internal vessel 2. The internal vessel 2 is initially formed as a cylindrical vessel using conventional means well known to those skilled in the art. The internal vessel 2 is initially a cylindrical vessel of a first external radius indicated as dimension "r". The internal vessel 2 can be formed initially in the known manner from recyclable aluminium or recyclable steel into a cylindrical open topped continuous vessel. The final forming of the top portion of the internal vessel 2 can then be accomplished by pressing and trimming the cylindrical blank in a forming die.

The internal vessel 2 has an outer bottom end 15, which when installed into the interior of the outer vessel 1 as shown in FIG. 2, abuts an interior bottom surface 16 of the outer vessel 1. The outer vessel 1 also comprises a substantially cylindrical vessel having a second internal radius "R" which is greater than the first radius "r" of the internal vessel 2.

The top upper rim 8 of the internal vessel 2 is formed into a substantially semi-circular shape having an external radius equal to the second radius "R". The top portion 17 of the internal vessel 2 comprises a transition surface between the substantially semi-circular top rim 8 and a bottom cylindrical portion 18 of the first radius "r". The transition surface 17 includes an upwardly sloped planar surface 19 which terminates in the straight planar second portion 9 of the rim 8. In the embodiment shown the second portion 9 is stepped downwardly a dimension "S" from the remainder of the top rim 8 due to the different heights of the final folded bead and central seam 10.

In order to form the internal vessel 2 as shown in FIG. 10 through 13, an initially open topped cylindrical blank may be flattened in a die to form the planar surface 19 at the same time as the upper substantially semi-circular rim 8 is formed to radius "R".

In the embodiment shown, the outer vessel 1 is of a shape conventional in the soft drink or beer can industry being a substantially cylindrical vessel having bottom portion of radius greater than the second radius R and a smooth tapered neck portion 23 merging with the bottom portion and the top edge 7.

In order to ensure that the overlapping portion of the top rim 8 and top edge 7 engage in close relationship, the internal radius of the top edge 7 and external radius of the top rim 8 are both substantially equal to the second radius R.

Also since the internal vessel 2 is advantageously constructed of an initially cylindrical vessel of external radius r, it will be apparent that there is a preferred relationship between the first radius r and second radius R in determining the preferred dimensions of the internal vessel 2. Since formation of the substantially semi-circular top portion should preferrably involve bending and not undue stretching of the material of the internal vessel 2, the length of the perimeter of the top rim 8 is approximately equal to the circumference of the bottom portion 18.

Figure 14:
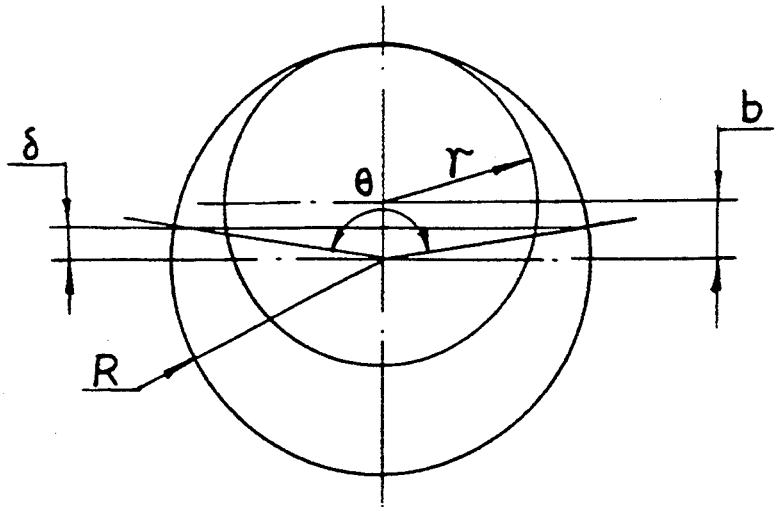
FIG. 14 is a sectional view along line 14—14 of FIG. 2, showing the preferred geometric relationship between the dimensions of the internal and outer vessels.

With reference to FIG. 14, the preferred relationship between the first and second radii is therefore described mathematically as follows:

$$\begin{matrix}\text{internal vessel 2} \\ \text{bottom circumference}\end{matrix} \leqq \begin{matrix}\text{internal vessel 2 top} \\ \text{perimeter length}\end{matrix}$$

$$2\pi r \leqq \pi\theta R/180 + 2R\mathrm{Sin}(\theta/2)$$

$$r \leqq R\left(\frac{\theta}{360} + \frac{\mathrm{Sin}(\theta/2)}{\pi}\right)$$

where: $168° \leqq \theta \leqq 179°$ then: $0.78317R \leqq r \leqq 0.81524R$

It will be apparent that e will always be less than 180° if the folded seam 10 is to be centered about the axis X—X of the cap. Other ranges for $\theta$ may be chosen if such a final appearance is not required, or if the volume in the first cell 4 and second cell 5 are not required to be equal.

Although this disclosure has described and illustrated certain preferred embodiments of the invention, as applied to a soft drink or beer can, it is to be understood that the invention is not restricted to these particular embodiments. Rather, the invention includes all embodiments which are functional or mechanical equivalents of the specific embodiments and features that have been described and illustrated herein.

I claim:

1. A multiple cell container comprising:

a hollow outer vessel having a top edge about a perimeter of an open top;

a hollow internal vessel having a top rim about a perimeter of an open top, the internal vessel being housed within the outer vessel, a first portion of the rim being in overlapping juxtaposition with an adjacent portion of the top edge, a second portion of the rim spanning across said open top of the outer vessel;

a cap closing said open tops of both the outer and internal vessels thus defining a first closed cell within the internal vessel and a second closed cell within the outer vessel external to the internal vessel, the cap comprising a one piece formed sheet having an inverted peripheral channel about an outer edge of said cap and an inverted interior channel spanning between and communicating with said peripheral channel, the peripheral channel of the cap being sealingly secured to the top edge of the outer vessel and the overlapping portion of the rim, and the interior channel being sealingly secured to the second portion of the rim, the interior channel and second rim portion defining a seam folded over a top face of the cap, wherein said internal vessel comprises a substantially cylindrical vessel of a first external radius, said outer vessel comprises a substantially cylindrical vessel of a second internal radius greater than said first radius, the top upper rim of said internal vessel being of substantially semicircular shape of external radius equal to said second radius, and a top portion of said internal vessel comprising a transition surface between said substantially semicircular top rim and a bottom cylindrical portion of said internal vessel of said first radius.

2. A multiple cell container according to claim 1 wherein the internal vessel has an outer bottom end abutting an interior bottom surface of said outer vessel.

3. A multiple cell container according to claim 1 wherein said transition surface includes an upwardly sloped planar surface terminating in the second portion of said rim, said second portion being planar.

4. A multiple cell container according to claim 1 wherein the first radius is in the range of 0.78317 to 0.81524 times the second radii.

5. A multiple cell container according to claim 1 wherein the outer vessel has a bottom portion of an internal radius greater than said second radius, a tapered neck portion merging said bottom portion and said top edge.

* * * * *